United States Patent [19]

Cox et al.

[11] Patent Number: 5,048,259

[45] Date of Patent: Sep. 17, 1991

[54] APPARATUS FOR INSTALLING OR REMOVING A LID FROM A STANDARD BARREL

[75] Inventors: Siegfried Cox, Mülheim; Rolf Schwerhoff, Borken; Ulrich P. Vogt, Essen, all of Fed. Rep. of Germany

[73] Assignee: Fried. Krupp GmbH, Essen, Fed. Rep. of Germany

[21] Appl. No.: 601,349

[22] Filed: Oct. 23, 1990

[30] Foreign Application Priority Data

Oct. 31, 1989 [DE] Fed. Rep. of Germany ..... 3936210

[51] Int. Cl.[5] ..... B65B 7/28; B65B 51/04

[52] U.S. Cl. ..... 53/132.1; 53/306; 53/307; 53/329; 53/138.2; 53/139.1; 53/381.4

[58] Field of Search ..... 53/286, 329, 287, 291, 53/132, 138 R, 139.3, 371, 381 A, 128, 133, 306, 307

[56] References Cited

U.S. PATENT DOCUMENTS

| | | | |
|---|---|---|---|
| 2,634,094 | 4/1953 | Kojan | 53/132 X |
| 2,762,177 | 9/1956 | Magnesen | 53/329 X |
| 2,862,340 | 12/1958 | Rauli | 53/287 |
| 3,264,795 | 8/1966 | Bauer | 53/138 R X |

FOREIGN PATENT DOCUMENTS

| | | |
|---|---|---|
| 211,321 | 7/1984 | Fed. Rep. of Germany. |
| 3,507,294 | 9/1985 | Fed. Rep. of Germany. |
| 254,300 | 2/1988 | Democratic Rep. of Germany. |

*Primary Examiner*—Horace M. Culver
*Attorney, Agent, or Firm*—Spencer & Frank

[57] ABSTRACT

A manipulating apparatus closes a standard barrel by picking up a lid, positioning it in the correct position above the barrel, pressing the lid onto the barrel, picking up a clamping ring, placing it in its spread-open state around the barrel top, and locking the clamping ring so as to retain the lid. The manipulating apparatus can also be used to open a closed barrel by moving a pivot member beneath the clamping lever of the clamping ring, rotating the pivot member to unlock the clamping ring, gripping the clamping ring, removing it while it is spread open, depositing the clamping ring at some convenient location, gripping the lid, removing the lid from the barrel, and depositing the lid. The manipulating apparatus is provided with three support arms (3–5) which form a support unit (1) which is movable horizontally and vertically by a guide unit (28) together with a central carrier (2) which projects beyond the support arms. Gripper mechanisms (10) are disposed at the support arms (3–5), along with holding cylinders (14) having holding rods (14a) which are displaceable toward the central carrier (2). A rotating unit (7) which is stationary relative to the support unit (1) is provided to rotate the pivot member (8).

15 Claims, 5 Drawing Sheets

APPARATUS FOR INSTALLING OR REMOVING A LID FROM A STANDARD BARREL

CROSS REFERENCE TO RELATED APPLICATION

This application claims the priority of an application, Ser. No. P 39 36 210.8, filed Oct. 31st, 1989 in the Federal Republic of Germany, the subject matter of which is incorporated herein by reference.

BACKGROUND OF THE INVENTION

The present invention relates to a manipulating apparatus for putting on and removing lids from standard barrels. More particularly, the invention relates to a manipulating apparatus for use with a standard barrel of the type having a barrel lip which is provided with externally projecting lip segments so that a lid with an externally disposed lid lip can be tightened by means of a releasable clamping ring having a U-shaped cross section. The clamping ring engages the sides of the barrel lip and the lid lip that face away from one another. The clamping ring is provided with a closing member which includes an externally disposed, pivotally fastened clamping lever whose movement between an open position and a closed position changes the diameter of the clamping ring.

Standard barrels made of plastic are often employed for storage and transport of substances. After they are manufactured (for example, by blow molding) these barrels are provided with lids and clamping rings during final assembly. Once the standard barrels are filled, appropriate process steps must be performed. This requires that the lids be removed from the standard barrels before filling.

SUMMARY OF THE INVENTION

It is an object of the present invention to provide a manipulating apparatus which permits lids to be applied to and removed from standard barrels by means of a machine.

Another object is to provide a manipulating apparatus which is configured so that it can be used as a component of an automatic system for final assembly in connection with the manufacture of barrels, and for re-installing lids in connection with the filling of barrels.

These objects can be attained by providing a manipulating apparatus which includes as its essential components a support unit, a guide unit, gripper members with tong arms and with tong base surfaces which provide pressure faces, holding cylinders, and a rotating unit including a pivot member. The support unit and its components are arranged, configured, and operated in a certain manner relative to one another to permit the application and removal of lids on standard barrels.

The support unit is composed of three radially arranged support arms and a central carrier connected therewith. When seen in the direction of the central axis of the central carrier and of the support unit, the central carrier projects at least on one side beyond the support arms. The central carrier is arranged in such a way with respect to the support arms that, in the horizontal position of the manipulating apparatus, it projects beyond the support arms on the side facing the standard barrel. That is, it is higher than the support arms.

The guide unit serves to move and position the support unit in the required manner. In any case, the guide unit must be configured in such a manner that the support unit is also able to perform a rotary movement about its central axis.

Within the scope of the invention, the guide unit may be composed of a carriage which is movable along a linear guide path and at which the support unit is held so as to be adjustable in height an rotatable.

In another advantageous embodiment, the guide unit is configured as a robot unit. That is, it includes at least one robot arm which is held so as to be movable in various directions and is possibly also rotatable.

Each support arm is equipped with a gripper member having tong arms which are oriented toward the central carrier and having a tong base surface which provides a pressure face oriented toward the central carrier. Both the tong arms and the pressure face are displaceable relative to the support arms in the direction of the central carrier. The tong arms and the tong base surfaces can be moved back and forth along the support arms. Moreover, the support arms are provided with holding cylinders having holding rods which are extendable in the direction toward the central carrier (and are correspondingly retractable in the opposite direction).

The rotating unit, which is stationary relative to the support unit, is equipped with a pivot member which lies between two adjacent support arms. The pivot member is movable about a pivot axis that is parallel to the central axis of the support unit and is provided with a carrying portion which is parallel thereto.

By actuating the rotating unit, the pivot member is able to move the clamping lever of the clamping ring to the closed position or the open position, and thus either lock or open the clamping ring. For removal of the lids, the support unit initially performs a limited rotary movement about its central axis, which causes the pivot member to move beneath the clamping lever of the clamping ring.

The manipulating apparatus according to the invention is configured in such a manner that, when a lid is put onto a standard barrel, the apparatus picks up the lid, places it in the correct position above the standard barrel in question, and presses the lid onto the barrel. The apparatus then picks up a clamping ring, spreads it apart, pushes it in its spread-open state over the standard barrel in question, positions it relative to the standard barrel, and then locks it.

During removal of the lid, the clamping ring is opened, then gripped, spread apart, lifted in its spread-open state beyond the lid, and deposited. The lid itself is then gripped, removed from the standard barrel, and deposited.

In more detail, when a lid is put on a standard barrel the support unit and its components are operated in such a manner that the holding rods are extended and later retracted again so as to pick up a lid from a supply position and place it onto the standard barrel. The lid is pressed onto the barrel by lowering the central carrier. A clamping ring is picked up by the gripper members. The clamping ring is spread open and moved to a position where it surrounds the lid, where it is supported on the extended holding rods at the height of the barrel lip and lid lip. Then, with the tong arms open, the clamping ring is pressed against the barrel lip and lid lip by pressing the tong base surfaces of the gripper members of two adjacent support arms against it. After the support unit has been rotated about its central axis, the clamping ring is locked in the closed position by means of the pivot mechanism, which moves the clamping lever toward the clamping ring.

To remove a lid, the support unit and its components are actuated in such a manner that, while the support unit is turned from time to time, the pivot lever moves beneath the clamping lever and the pivot member rotates to move the clamping lever into the open position. In the open position the clamping ring rests on the previously extended holding rods. With the tong arms open, and after the tong base surfaces of two adjacent support arms have been pressed against the barrel and lid lips, the gripper member of the third support arm grips the clamping ring. Then in cooperation with all gripper members, the clamping ring is raised in its spread-open state to a position above the lid, after which the clamping ring is deposited at some suitable location. Finally, the lid, which has been held by the tong arms between the lip segments of the standard barrel, is removed from the barrel and transported to a depositing station.

The manipulating apparatus according to the invention may include the further feature that the holding rods are disposed below the bottom end of the central carrier and, in the horizontal operating position of the support unit, the bottom end is oriented downwardly and can be pressed against the lid.

In adaptation to the arrangement of the support arms, the central carrier is advisably configured to have a triangular footprint and is advantageously dimensioned in such a way that a tolerance on the order of magnitude of several millimeters exists with respect to the dimensions of the lid.

In a preferred embodiment of the manipulating apparatus according to the invention, the gripper members are connected with the support arms by way of advancing members disposed below the support arms.

In order to ensure that the gripper members allow the clamping ring to slide during the spreading process and thus facilitate the expansion process, the tong arms—when seen from the side—are angular in configuration and define rectangular tong openings.

Advisably, the tong arms can be brought into an open position in which their tong arms form an angle of about 180° with one another.

The pressure faces which engage the clamping ring from time to time may each be provided by a wall section at the base of the housing, where it lies between the two tong arms and faces the central carrier. The advantage realized in this way is that only one advancing member is required for the tong arms and the associated pressure face.

In order to facilitate the exchange of support units in the case of malfunction, or to adapt it quickly and with little labor to standard barrels having different dimensions, the support unit is preferably releasably connected with the guide unit by way of an exchange plate.

The manipulating apparatus according to the invention can be advantageously modified by additionally equipping the support unit, preferably at the pressure face of the central carrier, with at least one holding unit which is able to lift a lid. In such an embodiment, the holding rods for manipulating the lid are not required.

Preferably the holding unit is configured as a suction gripper since the lids normally are manufactured of plastic.

Adaptation to different barrel sizes can be facilitated if the advancing members and the holding cylinders are mounted on the support arms so as to be displaceable relative thereto.

DESCRIPTION OF THE PREFERRED EMBODIMENT

A manipulating apparatus in accordance with the present invention is used for putting on and removing lids from standard barrels. Before the manipulating apparatus itself is described, the configurations of the standard barrels and their lids will be briefly discussed with reference to FIGS. 3–5.

The standard barrels 21 are equipped with external, projecting lip segments **21*b* which lie below the region of the barrel opening or mouth 21*a*. That is, the barrel lip is composed of a number of lip segments 21*b* which are spaced from one another in the circumferential direction of the standard barrel 21**.

The lid 23, which can be pressed onto the standard barrel by movement in the direction of arrow 22, is provided with a recess **23*b*. Lid 23 also includes a lid lip 23*a* which faces lip segments 21*b*. Lip 23*a* permits the lid 23 to be fastened to a standard barrel 21 by the action of a clamping ring 17**.

Figure 3:
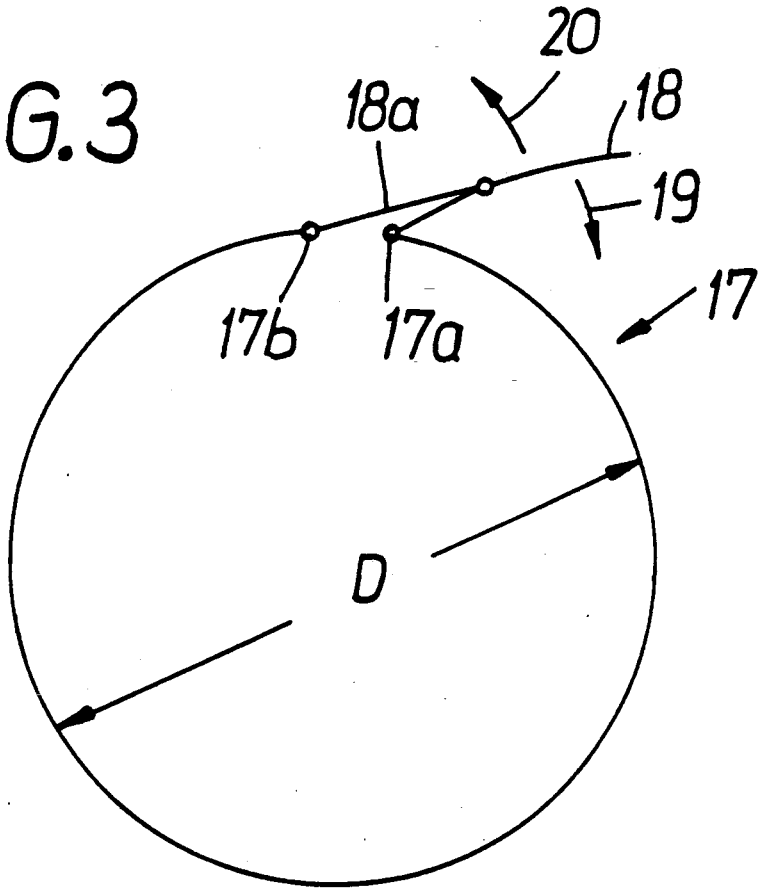
FIG. 3 is a schematic top view of a clamping ring for fastening a lid to a standard barrel.

Clamping rings 17 have a U-shaped cross section when open. In order to change its diameter D, each clamping ring 17 is equipped with a clamping lever 18 which is pivotally fastened to one of end **17*a* of the clamping ring 17 and to a guide member 18*a*. The guide member 18*a*, in turn, is hinged to the other end 17*b* of the clamping ring 17. By moving clamping lever 18 in the direction of arrow 19 (that is, clockwise in the direction toward clamping ring 17), the diameter D can be reduced until the clamping lever 18 has reached a closed position and lies against the clamping ring 17. By moving it in the direction of arrow 20 to the open position as shown in FIG. 3, the distance between ends 17*a* and 17*b***, and thus diameter D, is increased.

Figure 1:
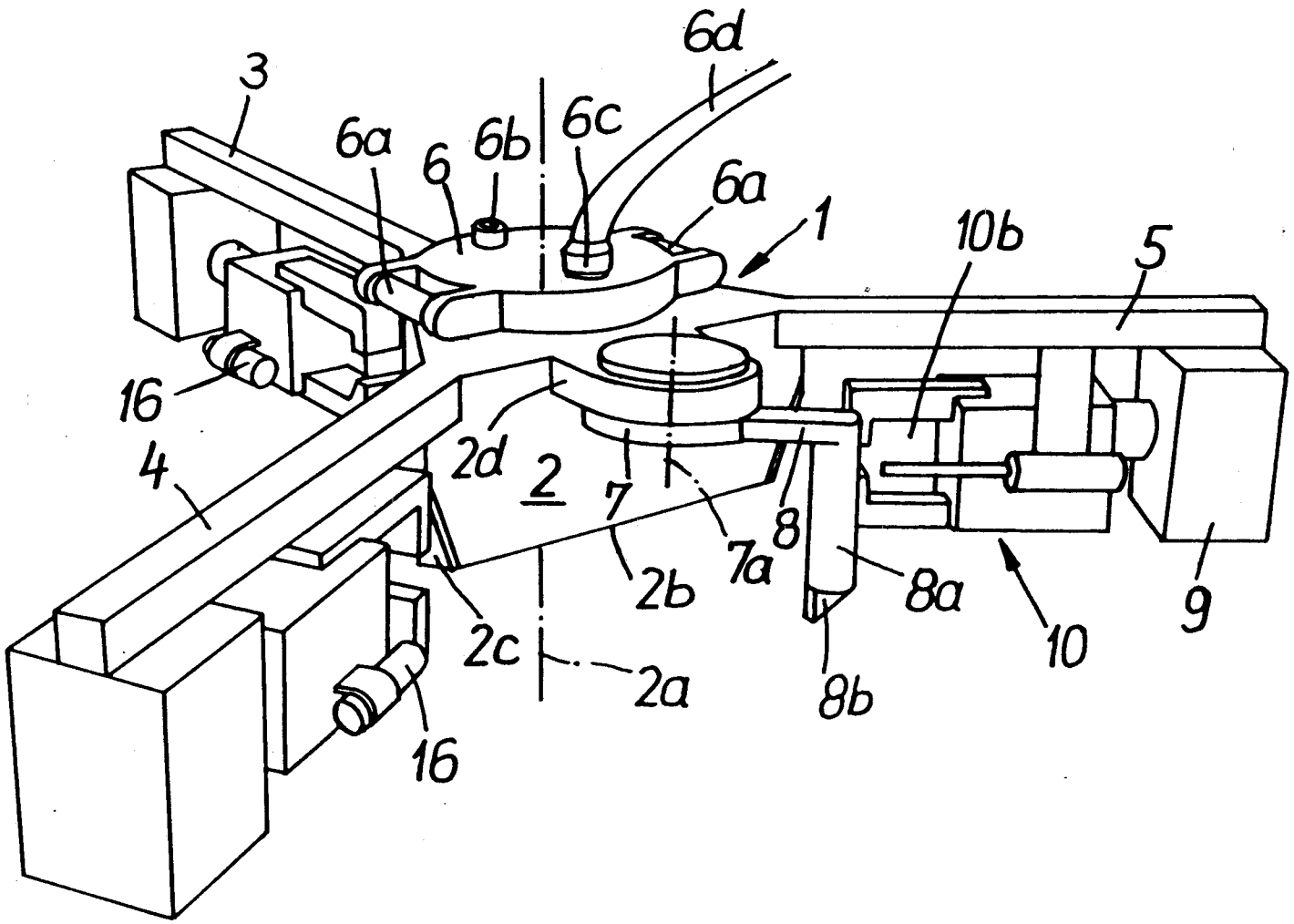
FIG. 1 is a perspective view schematically illustrating the support unit of a manipulating apparatus according to the invention (without the guide unit).

With reference next to FIG. 1, the manipulating apparatus of the present invention includes an inherently rigid support unit 1 which is composed of a central carrier 2 and three support arms 3 to 5. Support arms 3–5 are connected with the central carrier 2 and are radially oriented. The support arms 3–5 lie in a plane transverse to the center axis **2*a* of central carrier 2** and are offset by 120° relative to one another. Furthermore the support arms 3–5 are hollow in order to accommodate the necessary equipment, particularly supply and control lines.

When seen from the top, central carrier 2 has a generally triangular configuration due to the arrangement of support arms 3–5. When carrier 2 is in the horizontal operating position shown in FIG. 1, it projects downwardly beyond support arms 3–5 (that is, central carrier 2 has a greater height dimension than the support arms 3–5).

As will be described below, the downwardly disposed end face 2*b* of central carrier 2 serves as a pressing face by means of which a lid 23 can be pressed onto a standard barrel 21 so as to close it (see FIG. 4). Central carrier 2 has corner regions which, over part of their longitudinal extent, are equipped with metal centering sheets 2*c*. The centering sheets 2*c* terminate at end face 2*b* and extend at an angle relative to central axis 2*a* and in the direction toward axis 2*a*. The recess 23*b* of a lid 23 (see FIG. 4) is engaged with a play of several millimeters by the end face 2*b* of carrier 2 during the pressing-on process. That is, the dimensions of end face 2*b*, including metal centering sheets 2*c*, are selected such that the lid 23 is gripped with a tolerance of several millimeters and is automatically centered when it is pressed onto the standard barrel 21.

A change plate 6 is, for example, releasably held at central carrier 2 by a coupling (not shown). Support unit 1 is connected with a guide unit 28 (see FIG. 5) by way of change plate 6. Guide unit 28 enables the support unit 1 to be moved, oriented, and positioned in the manner required for putting on and removing lids 23 from standard barrels 21.

In the illustrated embodiment, the change plate 6 is equipped with two pins 6*a* by which it can be releasably snapped to the guide unit 28.

The support unit 1 is supplied with energy (for example, compressed air) by way of a compressed air port 6*b* attached to the change plate 6. A further compressed air port 6*c* and a compressed air conduit 6*d* are disposed opposite compressed air port 6*b* so as to open the already-mentioned coupling by charging it with pressure.

Between support arms 4 and 5, a projection 2*d* extends extends from central carrier 2 at the height of the support arms. A rotating unit 7 is carried by projection 2*d*. Rotating unit 7 includes a pivot member 8 with a carrying portion 8*a* connected thereto. Pivot member 8 is movable about a pivot axis 7*a* which is parallel to central axis 2*a*, and carrying portion 8*a* extends parallel to central axis 2*a*. At its free end, carrying portion 8*a* has a narrow guide member 8*b* which serves to thread pivot member 8 beneath the clamping lever 18 of the clamping ring 17 (see FIGS. 3 and 4).

Rotating unit 7 is actuated only if it is necessary, during the putting on and removing of a lid 23 from a standard barrel 21, to close or open the associated clamping ring 17 by the action of pivot member 8 on the clamping lever 18.

Figure 2:
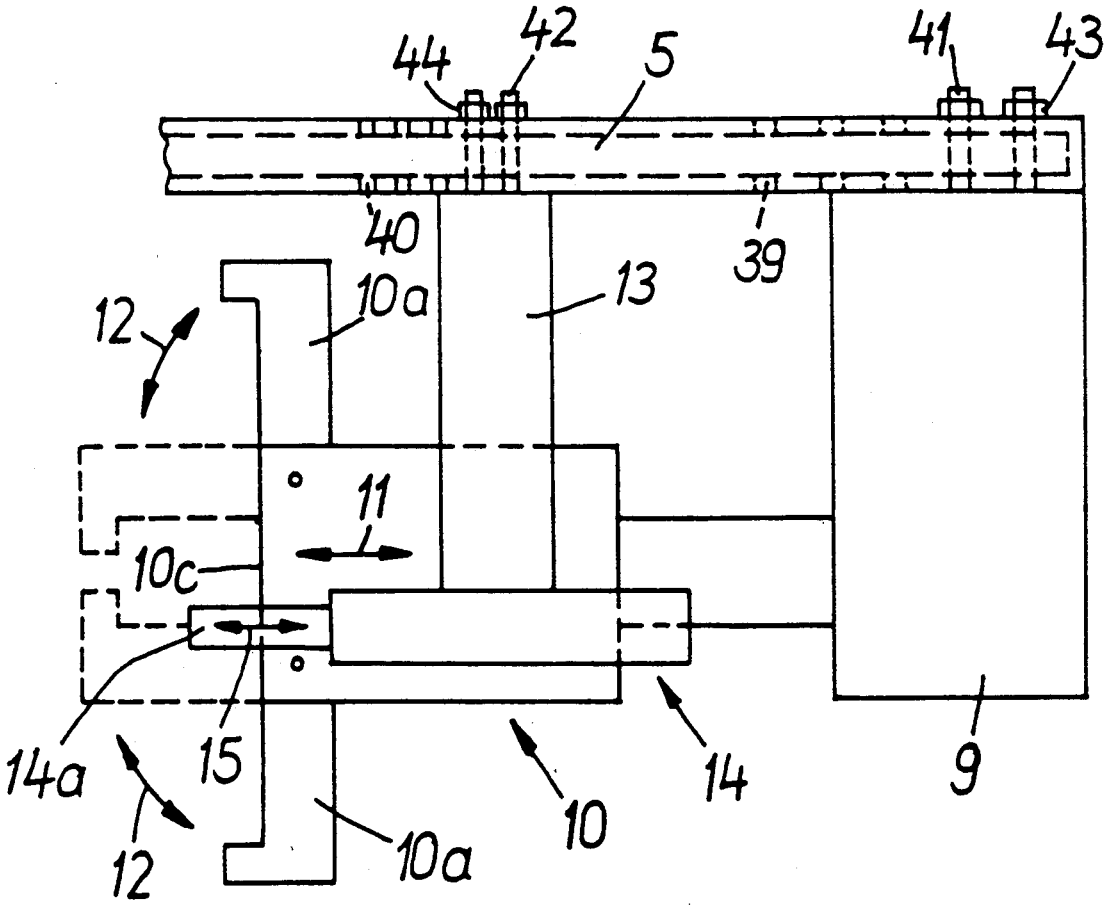
FIG. 2 is a highly schematic side view of a portion of a support arm, and the association of the advancing member, the gripper member, the pressure face at the base surface of the gripper member, and the holding cylinder below the support arm.

With reference next to FIGS. 1 and 2 together, advancing members 9 are supported at the underside of each of support arms 3–5. The advancing members 9 are operative to displace the respective gripper members 10, which are oriented toward central carrier 2, in the direction toward the carrier 2 (as indicated by the double arrow 11). Gripper members 10 have tong arms 10*a* with an angular configuration when seen from the side. In the closed position, tong arms 10*b* delimit a rectangular tong opening, marked 10*b*. Generally speaking, gripper members 10 and their tong arms 10*a* are configured and arranged in such a way that they interfere as little as possible with the spreading of clamping ring 17. As can be seen in FIG. 2, the tong arms 10*a*, which are pivotal in the direction of double arrows 12, can be brought into an open position in which they form an angle of 180° with respect to one another. A drive mechanism (not shown) is provided for opening and closing the tong arms 10*a*.

The opening movement of the tong arms 10*a* provides access to a tong base surface 10*c* which is provided by part of the housing of gripper member 10. Tong base surface 10*c* lies between tong arms 10*a* and faces central carrier 2. The surface 10*c* can be employed, when advancing member 9 provides pressure, to hold the clamping ring 17 in contact from time to time with the standard barrel 21 in question and its lid 23. Thus, advancing members 9 perform a dual function, since they permit displacement of gripper members 10 and since base surfaces 10*c* act as pressure faces.

Figure 5:
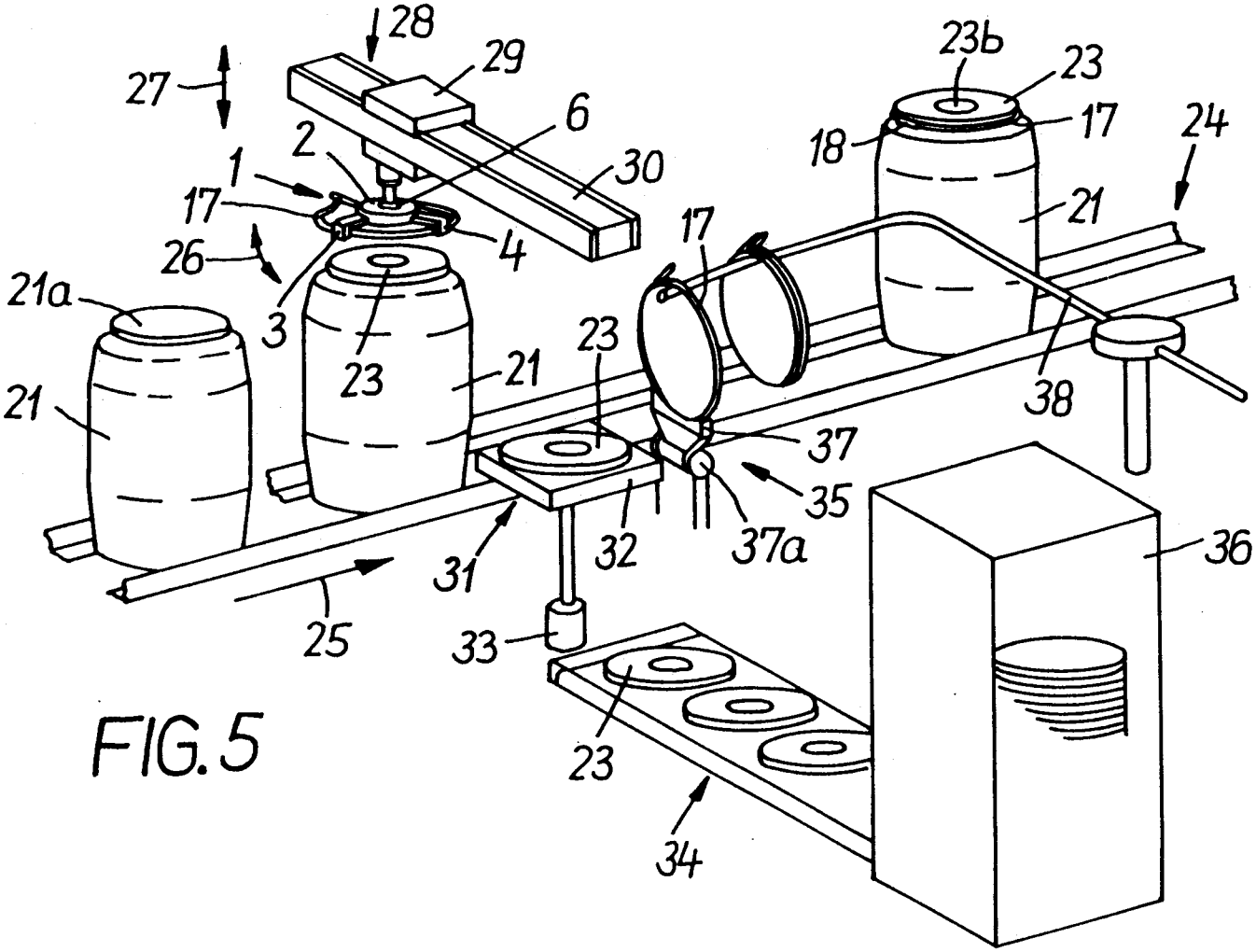
FIG. 5 is a perspective view schematically illustrating the configuration of a system for putting lids onto standard barrels.
Figure 6:
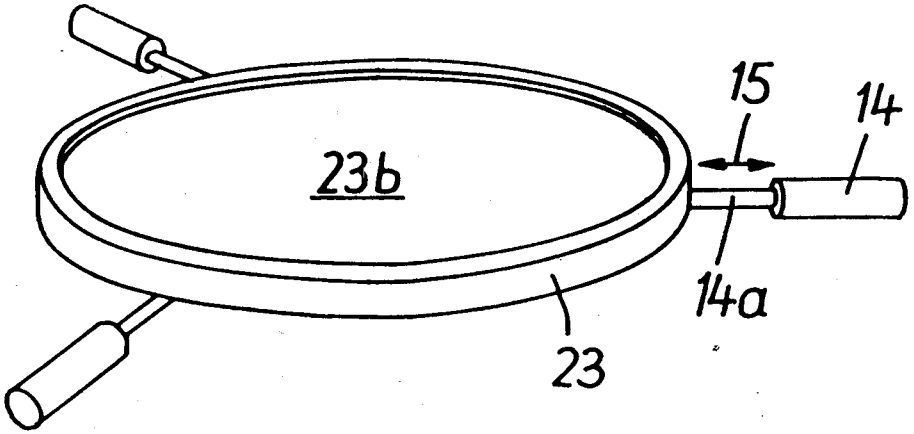
FIG. 6 is a perspective view schematically illustrating the operation of the holding cylinders for supporting the lid for a standard barrel.

Additionally, holding cylinder 14 is fastened to each support arm 3–5 by a respective metal support bracket 13 (see FIG. 2). Each holding cylinder 14 has a holding rod 14*a* which can be extended toward and retracted from central carrier 2 parallel to the associated support arm 3–5 in the direction of double arrow 15. Holding cylinders 14 are arranged next to the respective gripper members 10 in such a way that—corresponding to their intended purpose—they lie below the end face 2*b* of central carrier 2. By extending holding rods 14*a* in the direction of the central carrier 2 and its center axis 2*a*, the lid 23 and the clamping ring 17 for a standard barrel 21 can be picked up and positioned for the application and removal of lids as shown in FIGS. 5 and 6.

In the illustrated embodiment, the above-described drive members (that is, rotating unit 7, advancing members 9, the drive mechanism for tong arms 10*a*, and holding cylinders 14) are powered pneumatically. However, they may also be configured, at least in part, as hydraulic or electric assemblies.

On the side opposite the associated holding cylinder 14, each gripper member 10 is equipped with a sensor unit 16 as shown in FIG. 1. The sensor units 16 from time to time monitor the region below the end face 2*b* of the central carrier 2 for the presence of a clamping ring 17. If a sensor unit 16 does not detect a clamping ring 17 in the region scanned by it, it initiates a malfunction signal. If this signal is displayed optically and/or acoustically, it enables an operator to interrupt the manipulation process. If necessary, the malfunction signal may also be employed to at least partially stop the manipulating apparatus or the entire system of which it is a part.

If the clamping rings 17 employed (see, for example, FIGS. 3 and 4) are made of metal, sensor units 16 are equipped with inductively operating measuring sensors. However, (particularly for monitoring non-metallic clamping rings) the sensor units 16 may also be composed of transmitter/receiver units which react, for example, to reflected laser or infrared radiation.

Figure 4:
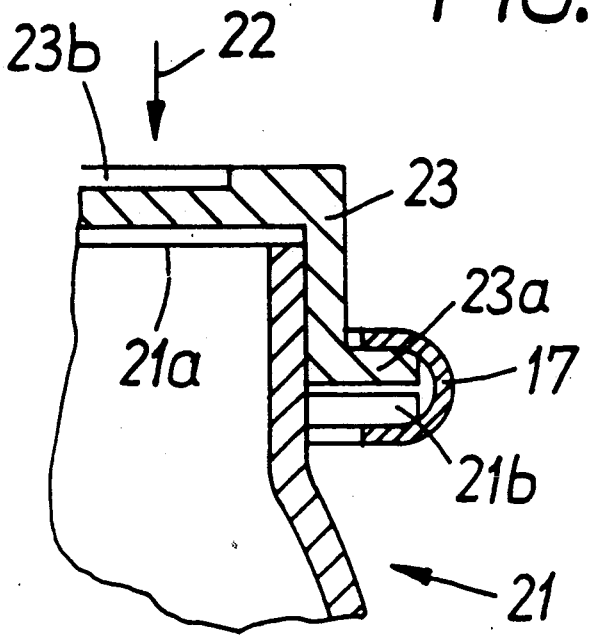
FIG. 4 is a vertical sectional view showing part of a standard barrel in the region of the barrel mouth, and also showing part of the lid and the clamping ring.

As will be appreciated from FIG. 4, during the closing and opening process clamping ring 17 must be positioned from time to time and held in contact with respect to lip segments 21*b* and lid lip 23*a*. For this purpose, holding rods 14*a* can be displaced in the direction toward the standard barrel 21 as previously discussed and can be held in a position below clamping ring 17 or in contact with it. Furthermore tong base surfaces 10*c* can be used for this purpose after the tong arms 10*a* have been opened.

The operation of the manipulating apparatus will now be described by discussing the process for putting on a lid 23.

In the system shown in FIG. 5, the standard barrels 21 are held upright in a stepwise advancing transporting unit 24. The barrels 21 are moved to the manipulating apparatus in the direction of arrow 25, initially without lids 23, and are then transported away with lids for further use. Through the intermediary of change plate 6 the manipulating apparatus (of which, for the sake of clarity, only central carrier 2 and support arms 3 and 4 are shown in FIG. 5) is held at a guide unit 28 so as to be pivotal about the central axis 2*a* shown in FIG. 1 (double arrow 26) and adjustable in height (double arrow 27). The guide unit 28 is composed of a carriage 29 which can be moved along a guide rail 30 into the region above a removal station 31.

The removal station 31 includes a table 32 which is adjustable in height by means of a lifting cylinder 33. On one hand the removal station 31 cooperates with the support unit 1, and on the other hand it cooperates alternatingly with a conveyor belt 34 and a transfer station 35. The top of table 32 is equipped with individual segments (not shown) on which the component to be held (lid 23 or clamping ring 17) is placed in such a manner that support unit 1 can move above the component and lift it.

Lids 23 are removed from a lid magazine 36 and transferred by the conveyor belt 34 to the appropriately lowered table 32. The clamping rings 17 are initially hung on a rod magazine 38. The clamping rings 17 are removed from rod magazine 38 and deposited by transfer station 35 on table 32, in an appropriately raised position. Transfer station 35 includes a gripping arm 37 which is pivotal about a horizontal axis 37*a*.

In order to pick up a lid 23 that has been placed on table 32, the support unit 1 is moved by carriage 29 into a suitable position above table 32 before holding rods 14*a* are extended in such a manner that they move underneath the lid 23. The cooperation of holding rods 14*a* results in a three-point support for the respective lid 23 (see FIG. 6). The lid 23, held in this manner, is lowered toward the respective stationary standard barrel 21 and then released by retracting holding rods 14*a*. Subsequent further lowering of support unit 1 causes end face 2*b* of support unit 1 (see FIG. 1) to press the lid 23 onto the standard barrel 21.

Figure 7:
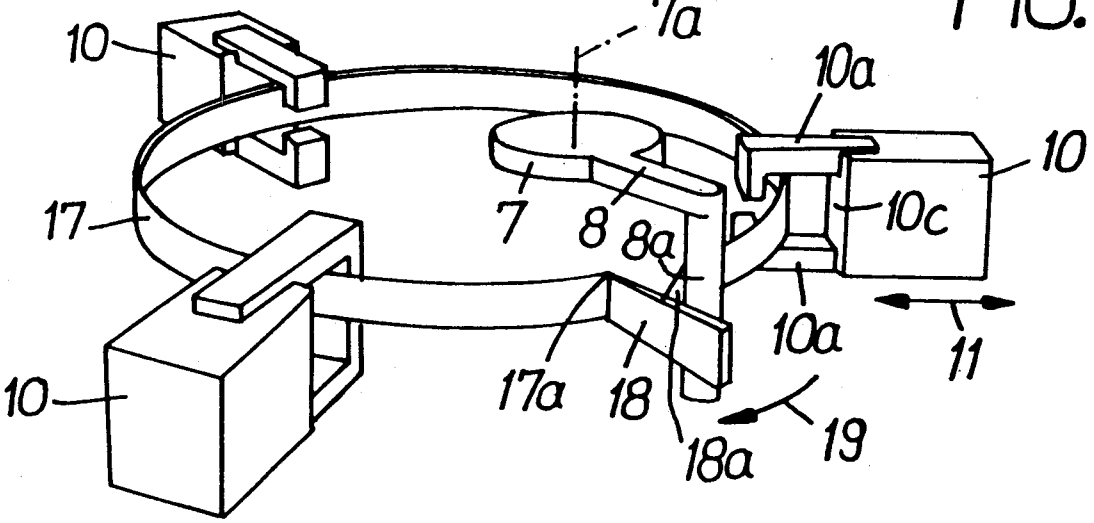
FIG. 7 is a perspective view schematically illustrating the gripping and spreading open of a clamping ring by several gripper members.

Simultaneously, gripping arm 27 is actuated to cause a clamping ring 17 to be deposited on table 32. The clamping ring 17 is picked up by closing tong arms 10*a* after support unit 1 has been moved to a position above table 32 (see FIG. 7).

Due to the configuration of tongs arms 10*a*, the clamping ring 17 can be easily spread apart by retraction of advancing members 9. As soon as carriage 29 and support unit 1 have been moved to a position above lid 23 the clamping ring 17 is brought into the effective range of pivot member 8 by rotating support unit 1 about center axis 2*a* (see FIG. 1).

Before the tong arms 10*a* are opened, holding rods 14*a* are extended toward standard barrel 21 to such an extent that they hold the clamping ring 17 at the height of lid lip 23*a* and lip segments 21*b* (see FIG. 4). To fix the open clamping ring 17, two advancing members 9 are then extended until the associated tong base surfaces 10*c* become effective as pressure faces. That is, the tong base surfaces 10*c* press clamping ring 17 in the required manner against components 23*a* and 21*b*. Now, actuation of rotating unit 7 and the action of pivot member 8 can cause the clamping lever 18 to pivot toward the clamping ring 17 and thus move it into the closed position (see FIG. 3), in which lid 23 is clamped to standard barrel 21 (see FIG. 4).

Upon completion of the closing process, holding rods 14*a* and advancing members 9 are retracted. Support unit 1 is raised beyond lid 23 and the closed standard barrel 21 can be moved out to the right (with respect to FIG. 5) by transporting unit 24.

The lid removing process takes place as follows: Initially, with tong arms 10*a* open and holding rods 14*a* retracted, support unit 1 is lowered down to a lid 23 which is closed by a clamping ring 17. The support unit 1 is rotated about the central axis 2*a* of central carrier 2 until it is brought into a position in which the guide member 8*b* of the pivot member 8 is able to move beneath the clamping lever 18 in its closed position. Rotating unit 7 is actuated to pivot the clamping lever 18 into the open position. Before the clamping ring 17 is opened, holding rods 14*a* are extended toward the standard barrel 21 until they prevent the open clamping ring 17 from falling. The advancing members 9 of two adjacent support arms are extended so that the respective tong base surfaces 10*c* push the clamping ring 17 into an eccentric position relative to standard barrel 21. In this eccentric position, the clamping ring 17 is initially gripped by the gripper member 10 of the third support arm. The gripper member 10 of this third support arm is then moved toward the standard barrel, making the clamping ring 17 accessible to the other gripper members 10. Then the clamping ring 17 is spread apart by retracting all of the advancing members 9. With holding rods 14*a* now being retracted, the clamping ring 17 is raised beyond lid 23 and deposited at the desired location.

After the clamping ring 17 has been deposited and support unit 1 has been returned, it is lowered toward lid 23. The advancing members 9 are extended and tong arms 10*a* are closed to grip the lip 23*a* of lid 23. Lid 23 is removed from the standard barrel 21 by moving the support unit 1 upward. The removed lid 23 is then deposited at a desired location by suitable movement of the support unit 1 and opening of the tong arms 10*a*.

The removal of lid 23 from standard barrel 21 is possible only if the tong arms 10*a* engage exclusively at lid lip 23*a*. For that reason, the barrel lip is composed of lip segments 21*b* (see FIG. 4) which are spaced sufficiently far apart.

In order to easily adapt the support unit 1 to different standard barrel and lid configurations, advancing members 9 and also holding cylinders 14 are displaceably connected with the respectively associated supporting arms 3 to 5.

The advantage realized with the present invention is, among others, that even with relatively large dimensional inaccuracies of the standard barrel 21, the lid 23, and the clamping ring 17, the required operational reliably is not jeopardized; if desired, primarily commercially available components can be employed. The support unit 1 can be adapted in a simple manner to different barrel sizes and can be integrated in a fully automatic system.

In deviation from the embodiment described in detail above, the support unit 1 may additionally be equipped with at least one holding unit, particularly a suction gripper. Without interfering with its function as a pressure face, such a suction gripper could be integrated in the lower end the central carrier 2.

The suction gripper could be employed instead of the holding rods 14a to pick up a lid 23 and place it onto a standard barrel 21.

Adaptation to different barrel sizes can (as mentioned above) be facilitated if the advancing members 9 and holding cylinders 14 are displaceable relative to the supporting arms 3 to 5.

For this purpose (see FIG. 2), each hollow supporting arm 3, 4 and 5 is equipped with bores 39 and 40 for fastening the advancing members 9 and metal support brackets 13 of the holding cylinders 14, the bores are arranged in that way, that they are spaced at equal distances, respectively.

The sections of parts 9 and 13 facing the associated supporting arm are provided with threaded bolts 41 and 42 respectively, which may engage two neighboured bores 39 or 40 and can be fixed to part 9 or 13 by nuts 43 or 44.

In the embodiment in question, in each supporting arm 3 to 5 are disposed five bores 39 and 40 to hold parts 9 and 13 relative to the associated supporting arm in a desired position.

It will be understood that the above description of the present invention is susceptible to various modifications, changes, and adaptations, and the same are intended to be comprehended within the meaning and range of equivalents of the appended claims.

What is claimed is:

1. A manipulating apparatus for selectively closing a standard barrel having a barrel mouth and having externally projecting lip segments around the barrel mouth by positioning at the barrel mouth a lid having an externally disposed lid lip so that an inner side of the lid lip faces an inner side of the lip segments, and by installing a releasable clamping ring which engages an outer side of the lid lip and an outer side of the lip segments to tighten the lid lip toward the lip segments, the clamping ring having a U-shaped cross-section and being provided with a closing means which includes an externally disposed and pivotally connected clamping lever whose movement between an open position and a closed position changes the diameter of the clamping ring, or for selectively opening the barrel by removing the clamping ring and lid, said manipulating apparatus comprising:

a rigid support unit which includes a central carrier having a bottom side and at least three radially oriented support arms extending from the central carrier, the bottom side of the central carrier projecting below the support arms, the support unit having a central axis which passes through the bottom side of the central carrier;

guide unit means for moving the support unit horizontally and vertically and for rotating the support unit about its central axis;

gripper mechanisms movably mounted on the support arms, each gripper mechanism including gripping tongs which are oriented toward the central carrier and including a tong base surface facing the gripper tongs;

advancing units which are mounted on the support arms to displace the gripper mechanisms relative to the respective support arms toward or away from the central carrier;

holding cylinders attached to the support arms and including holding rods which can be extended toward the central carrier; and a rotating unit mounted on the support unit, the rotating unit including a pivot member which is movable between adjacent support arms about a pivot axis that is parallel to the central axis of the support unit, the pivot member having a carrying portion which extends parallel to the central axis of the support unit, wherein, in order to close the barrel, the lid is picked up from a supply station by the support unit with the holding rods temporarily extended and transferred to the mouth of the barrel, the lid is pressed onto the barrel by lowering the central carrier, a clamping ring is then picked up by the support unit and spread open and, after being transferred to the barrel and being lowered around the lid, the clamping ring is supported on extended holding rods at the height of the lip segments and the lid lip, the clamping ring is pressed against the lip segments and lid lip by the tong base surfaces of the gripper mechanisms mounted on a pair of adjacent support arms while the gripper tongs of the respective gripper mechanisms are open, and the clamping lever is moved toward to its closed position by the pivot member, and wherein, in order to open the barrel, the pivot mechanism is moved beneath the clamping mechanism, with the support unit turning from time to time, and the pivot mechanism moves the clamping lever into its open position, the clamping ring is pressed against the lip segments and lid lip by the tong base surfaces of the gripper mechanisms mounted on a pair of support arms while the clamping ring rests on extended holding rods, the clamping ring is gripped by the gripping tongs of another gripper mechanism, the clamping ring is spread open by all of the gripper mechanisms and raised in its spread-open state, after the clamping ring is deposited the lid is gripped by the gripping tongs between its lip segments, and the lid is removed from the barrel by the support unit and transferred to a deposit station.

2. The apparatus of claim 1, wherein the bottom side of the central carrier presses the lid onto the barrel during closure of the barrel, and wherein the holding rods are disposed below the bottom side of the central carrier.

3. The apparatus of claim 1, wherein the bottom side of the central carrier is generally triangular.

4. The apparatus of claim 1, wherein the advancing units are disposed below the support arms.

5. The apparatus of claim 1, wherein the gripping tongs of each gripper mechanism comprise a pair of tong arms which are angular when seen from the side, and wherein each gripper mechanism has a closed position in which the respective tong arms define a rectangular opening.

6. The apparatus of claim 5, wherein each gripper mechanism additionally has an open position in which the respective tong arms are disposed at an angle of about 180° with respect to one another.

7. The apparatus of claim 1, wherein each gripper mechanism comprises a housing having a housing wall, and wherein the tong base surface is provided by a portion of the housing wall disposed between the respective gripping tongs.

8. The apparatus of claim 1, further comprising means for releasably connecting the support unit to the guide unit means.

9. The apparatus of claim 1, wherein the advancing units and the holding cylinders are mounted on the support arms so as to be displaceable in the longitudinal direction of the support arms.

10. A manipulating apparatus for selectively closing a standard barrel having a barrel mouth and having externally projecting lip segments around the barrel mouth by positioning at the barrel mouth a lid having an externally disposed lid lip so that an inner side of the lid lip faces an inner side of the lip segments, and by installing a releasable clamping ring which engages an outer side of the lid lip and an outer side of the lip segments to tighten the lid lip toward the lip segments, the clamping ring having a U-shaped cross-section and being provided with a closing means which includes an externally disposed and pivotally connected clamping lever whose movement between an open position and a closed position changes the diameter of the clamping ring, or for selectively opening the barrel by removing the clamping ring and lid, said manipulating apparatus comprising:

a rigid support unit which includes a central carrier having a bottom side and at least three radially oriented support arms extending from the central carrier, the bottom side of the central carrier projecting below the support arms, the support unit having a central axis which passes through the bottom side of the central carrier;

means for moving the support unit horizontally and vertically and for rotating the support unit about its central axis;

first means for supporting at least one of the lid and the clamping ring below the support unit, the first means including gripper mechanisms movably mounted on the support arms, each gripper mechanism having a housing with a tong base surface which faces the central carrier and additionally having at least one gripping tong which is pivotable between an open position and a closed position, the at least one gripping tong being disposed between the tong base surface and the central carrier when in the closed position but not when in the open position;

advancing units which are mounted on the support arms to displace the gripper mechanisms relative to the respective support arms toward or away from the central carrier;

second means for supporting at least one of the lid and the clamping ring below the support unit, the second means including holding cylinders attached to the support arms and holding rods which can be extended toward the central carrier by the holding cylinders; and rotating unit means mounted on the support unit for selectively moving the clamping lever of the clamping ring between its open and closed positions, the rotating unit means including a pivot member which is movable between adjacent support arms about a pivot axis that is parallel to the central axis of the support unit, the pivot member having a carrying portion which extends parallel to the central axis of the support unit, wherein the first means additionally provides means for spreading the clamping ring outward with the gripping tongs of the gripper members when the gripper tongs are in their closed position and for pressing the clamping ring inward with the tong base surfaces of the gripper members when the gripping tongs are in their open position.

11. The apparatus of claim 10, wherein each gripper member has more than one gripping tong.

12. The apparatus of claim 11, wherein the gripping tongs of each gripper member are pivotably mounted on the housing of the respective gripper member.

13. The apparatus of claim 12, wherein the gripping tongs are generally L-shaped.

14. The apparatus of claim 10, wherein the tong base surfaces are flat and lie in planes which are substantially parallel to the central axis of the central carrier.

15. The apparatus of claim 10, further comprising means mounted on the housings of the gripper members for sensing the presence of the support ring.

* * * * *